US006216652B1

(12) United States Patent
Gramann et al.

(10) Patent No.: US 6,216,652 B1
(45) Date of Patent: Apr. 17, 2001

(54) METHOD FOR OPERATING ACTUATORS FOR ELECTROMAGNETICALLY CONTROLLING A VALVE

(75) Inventors: Matthias Gramann, Neunkirchen; Michael Nagel, Nuremberg; Reinhard Orthmann, Mainz; Hans-Peter Schoener, Modautal; Holger Steffen, Stuttgart; Werner Wiedemann, Herzogenaurach; Rudolf Wilczek, Altdorf, all of (DE)

(73) Assignee: DaimlerChrysler AG Stuttgart (DE)

( * ) Notice: Subject to any disclaimer, the term of this patent is extended or adjusted under 35 U.S.C. 154(b) by 0 days.

(21) Appl. No.: 09/535,957

(22) Filed: Mar. 27, 2000

(30) Foreign Application Priority Data

Mar. 31, 1999 (DE) ..... 199 14 593

(51) Int. Cl.[7] ..... F01L 9/04

(52) U.S. Cl. ..... 123/90.11; 123/90.19; 123/90.33; 251/129.1; 251/129.16

(58) Field of Search ..... 123/90.11, 90.19, 123/90.33; 251/129.01, 129.05, 129.1, 129.15, 129.16

(56) References Cited

U.S. PATENT DOCUMENTS 6,085,704 * 7/2000 Hara ..... 123/90.11
6,116,570 * 9/2000 Bulgatz et al. ..... 251/129.1

* cited by examiner

*Primary Examiner*—Weilun Lo
(74) *Attorney, Agent, or Firm*—W. F. Fasse; W. G. Fasse

(57) ABSTRACT

A method of operating an actuator for electromagnetically controlling a valve in an internal combustion engine involves supplying a heating current to the operating coils of the actuator before starting the internal combustion engine from a cold start condition. Thereby, the operating coils, the components surrounding them, and the lubricant are heated to ensure proper viscosity of the lubricant and thus proper operation of the actuator.

6 Claims, 2 Drawing Sheets

METHOD FOR OPERATING ACTUATORS FOR ELECTROMAGNETICALLY CONTROLLING A VALVE

FIELD OF THE INVENTION

The invention relates to a method for operating actuators for electromagnetically controlling a valve in internal combustion engines, an actuator having two electromagnets, an opening magnet and a closing magnet between which a retaining plate with at least one plunger oscillates, each electromagnet comprising a yoke and an operating coil, where at least one yoke has a guide sleeve supplied with lubricant for guiding at least one plunger and where the actuator goes through an initial transient state by energizing the electromagnets before the internal combustion engine is started.

BACKGROUND INFORMATION

An actuator for electromagnetically controlling a valve consists essentially of an opening magnet and a closing magnet separated from one another by a component made of non-ferromagnetic material and designed, for example, as a housing part. The opening magnet and the closing magnet are electromagnets, each comprising an operating coil and a yoke. Between opening magnet and closing magnet there is a retaining plate made of ferromagnetic material and moved in the respective direction by energizing the operating coil of the opening magnet or the operating coil of the closing magnet. The opening magnet has a bushing for a plunger which transmits the forces acting on the retaining plate to at least one gas change valve. In some actuator designs, the closing magnet also has a bushing in which a pushrod is located that transmits the forces acting on the retaining plate via an actuator spring plate to an actuator spring placed in a formed shape of the closing magnet.

In the case of actuators without pushrod, the actuator spring is as a rule placed between an actuator spring plate located on the plunger and the outside of the opening magnet.

The plunger and, where applicable, the pushrod, are mounted in guide sleeves that are built into the bushing in the yoke of the opening magnet and in the yoke of the closing magnet. The guide sleeves have channels through which the plunger oscillating in the guide sleeve and, where applicable, the pushrod are supplied with lubricant.

An actuator forms together with a gas change valve a functional unit, where the gas change valve, corresponding to a conventional cylinder head with camshafts, is drawn into the valve seat of the cylinder head by means of a valve spring and a valve spring plate.

If a functional unit comprising an actuator and a gas change valve is fitted to the internal combustion engine, the actuator spring and the valve spring are preloaded and at least one gas change valve, the plunger with the retaining plate and, where applicable, the pushrod are pushed against one another.

In the non-operated position of the functional unit, the retaining plate is located precisely in the center between the opening magnet and the closing magnet. The gas change valve is then in a central position between the valve seat of the cylinder head and the position in which the valve is opened to the maximum.

When starting up an actuator from the non-operated state, there is an initial transient state in which, for example, the operating coils of the two electromagnets are supplied with current alternately. As initial transient frequency of the spring-mass system, a frequency is selected that is preferably in the proximity of the resonant frequency which is due to the oscillating mass of the functional unit and to the resetting force of the valve spring and of the actuator spring.

A typical initial transient state is shown in FIG. 3. The operating coils of the electromagnets were each supplied here with current eight times before the closing magnet drew the gas change valve completely into the valve seat. Currents of up to 30 amperes were reached in the process.

When the internal combustion engine is in operation, the operating coils of the actuators are supplied with current according to precisely dimensioned current curves in order to position the gas change valves exactly. These current curves are usually controlled in a closed loop by, for example, determining the actual position of an oscillating component through a sensor arrangement of the control loop, and correcting the current curves of the operating coils accordingly when a deviation occurs between the desired position and the actual position of the oscillating component.

One disturbance leading to the occurrence of large deviations is the temperature-dependent frictional resistance of the actuator. Particularly when starting the internal combustion engine from cold at low outside temperatures, the increased resistance of the lubricant due to it still being cold and viscous produces the problem of the operating coils of the actuators being subjected to current curves for the initial transient state having very high current values. The current source made available for the actuators must therefore be designed to provide very high currents. Furthermore, an increased number of alternating energizing cycles is required for the operating coils. High deviations result in an increased number of control cycles until the specific actual values in the control loop correspond to the preset desired values.

SUMMARY OF THE INVENTION

The object of the invention is to specify a method for the operation of actuators for electromagnetically controlling a valve in internal combustion engines where excessive currents in the operating coil of the opening magnet and in the operating coil of the closing magnet are avoided when starting the internal combustion engine from cold, especially in the initial transient state of the actuators, where the number of control cycles required for closed-loop control is kept small and where a control unit assigned to the actuators can be designed to provide smaller currents.

The above object has been achieved according to the invention in a method of operating an actuator for electromagnetically controlling a valve in an internal combustion engine, using an actuator having two electromagnets including an opening magnet and a closing magnet between which a retaining plate with at least one plunger oscillates. Each electromagnet includes a yoke and an operating coil, wherein at least one yoke has a guide sleeve supplied with lubricant for guiding the at least one plunger. In the method according to the invention, the actuator goes through an initial transient state by energizing the electromagnets before the internal combustion engine is started. Furthermore, before the initial transient state of the actuator commences, at least one of the operating coils of the electromagnets which has a guide sleeve is supplied with a heating current that causes the at least one operating coil and the lubricant to be heated.

Provision is made in a further development of the invention for the heating current used to heat the operating coil and the lubricant of the guide sleeve to be controlled in an open loop and/or in a closed loop, where the temperature and/or the energization time and/or the current level and/or the position of an oscillating part of the actuator is used as controlled variable.

In yet another further development of the invention, provision is made for oil to be used as lubricant, and for the temperature of the oil present on a guide sleeve to be measured by means of a sensor in order to control the heating current in an open loop or in a closed loop on the basis of temperature.

In a simple embodiment of the invention, the operating coils are supplied for the purposes of heating with a direct current as heating current. The operating coils of an actuator can be energized differently here, also singly, the current preferably being kept so small that the retaining plate is not moved out of its non-operated position.

For a particularly short period of heating, a high direct current can be applied as heating current to both operating coils; both electromagnets of the actuator act against each other here, and consequently the retaining plate is also not moved away from its non-operated position.

In an alternative embodiment of the invention, the operating coils of the actuators are supplied for the purposes of heating with an alternating current as heating current. In the case of an alternating current of suitable frequency (which is sufficiently higher/lower than the resonant frequency), again the retaining plate cannot be moved away from its non-operated position in spite of high heating currents, and therefore this embodiment is particularly suitable if only one operating coil of an actuator is supplied with heating current for heating purposes and the retaining plate is not to be moved away from the non-operated position.

The power provided by the heating current is controlled in an open loop or in a closed loop by the pulse width modulation and/or the amplitude modulation.

Through the described method for operating an actuator for electromagnetically controlling a valve in internal combustion engines, the lubricant between the plungers and the guide sleeves of the electromagnet of an actuator with a guide sleeve is heated by a heating current before the initial transient state, and therefore excessively high currents in the operating coils of the actuators are avoided in the initial transient state of the actuators and when starting the internal combustion engine, the number of required control cycles in a control system is kept small, and the control unit assigned to the actuators can be designed in total for smaller currents.

The method for operating an actuator for electromagnetically controlling a valve in internal combustion engines will now be described and explained on the basis of an example of embodiment in conjunction with three Figures.

BRIEF DESCRIPTION OF THE DRAWINGS

The drawings show:

Figure 1:
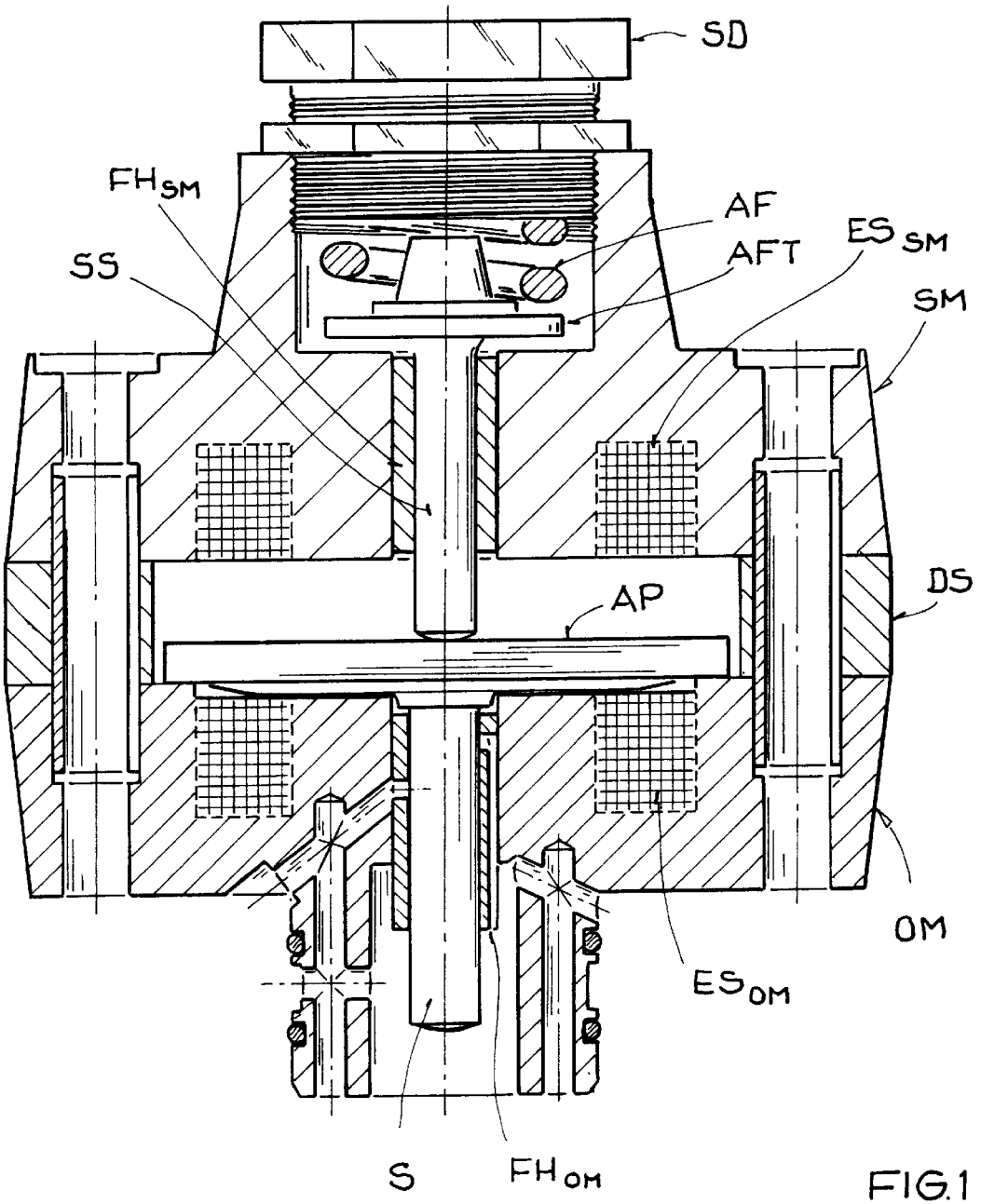
Figure 2:
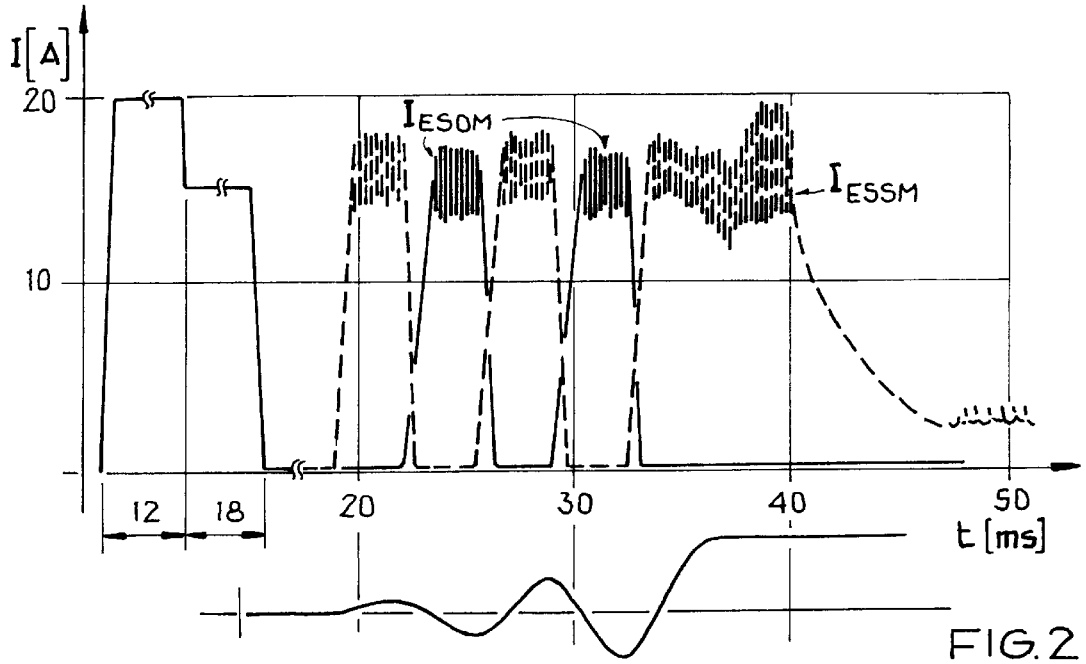

| | |
|---|---|
| FIG. 1 | Schematic representation of an actuator for electromagnetically controlling a valve. |
| FIG. 2 | Schematic representation of the current curve in the initial transient state of an actuator for electromagnetically controlling a valve, after a heating current has been applied. |

-continued

Figure 3:
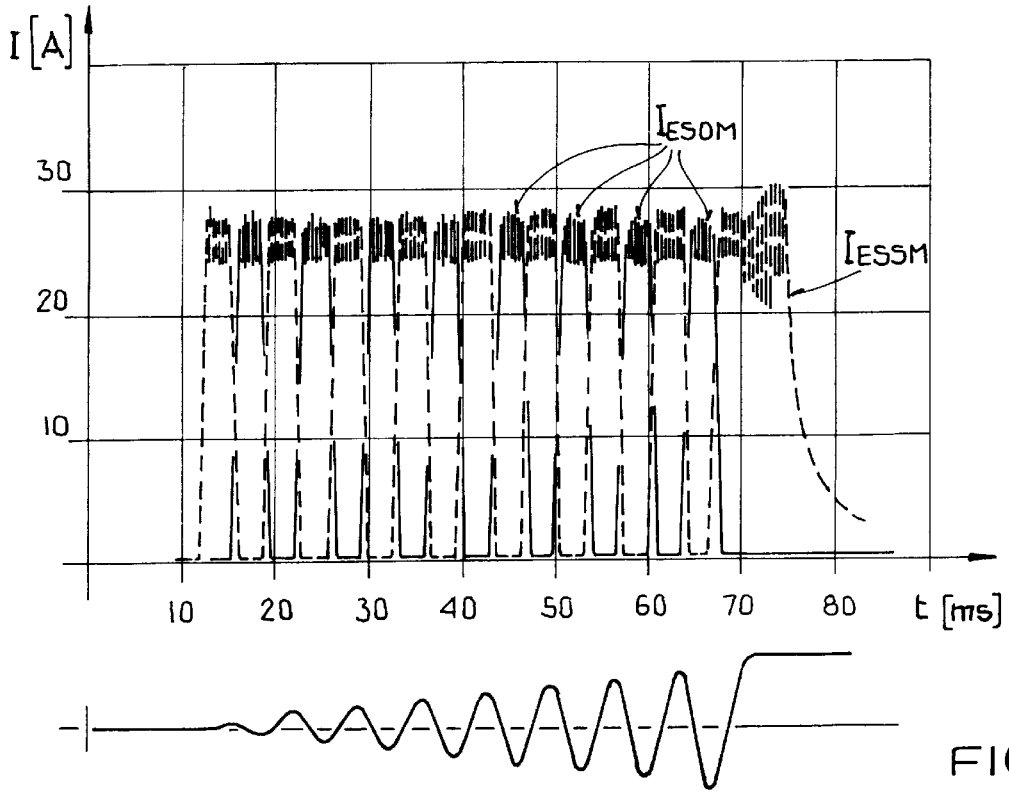

| | |
|---|---|
| FIG. 3 | Schematic representation of the current curve in the initial transient state of an actuator for electromagnetically controlling a valve, without a heating current having been applied. |

DESCRIPTION OF A PREFERRED EMBODIMENT

FIG. 1 shows in schematic form a rectangular actuator for electromagnetically controlling a valve. The yoke of the opening magnet ÖM and the yoke of the closing magnet SM, each of which has a hollow cylindrical coil window for installing an operating coil ESÖM,ESSM, are separated from one another by two spacers DS made of a non-ferromagnetic material. The rectangular retaining plate AP oscillates between spacers DS. The plunger S, which transmits the forces acting on the retaining plate AP through a bushing in the yoke of the opening magnet ÖM to a gas change valve, is fastened to the retaining plate AP. In the extension of the plunger S, a pushrod SS bears against the retaining plate AP and through a bushing in the yoke of the closing magnet SM transmits to the actuator spring AF the forces acting on the retaining plate AP. For this purpose, pushrod SS has an actuator spring plate AFT on which the actuator spring AF rests and via which the actuator spring AF presses the pushrod SS against the retaining plate AP. The actuator spring AF is situated in a formed shape of the yoke of the closing magnet SM, radially symmetrically around the bushing of the pushrod SS. The formed shape of the yoke of the closing magnet SM has a thread on the inside into which a screw cap SD is screwed. By means of the screw cap SD, the preloading of the actuator spring AF can be changed and thus the non-operated position of the retaining plate AP can be set.

A guide sleeve FHÖM is pressed into the bushing of the opening magnet ÖM for the plunger S and a guide sleeve FHSM is pressed into the bushing of the closing magnet SM for the pushrod SS. Oil channels have been drilled in the guide sleeves FHÖM,FHSM; these are connected to the oil circuit of the internal combustion engine and are supplied with oil for lubrication via the plunger S and the pushrod SS.

The operating coil ESÖM of the opening magnet ÖM and the operating coil ESSM of the closing magnet SM are designed differently in accordance with their slightly different tasks. Whereas the operating coil ESÖM of the opening magnet ÖM that opens in opposition to the combustion chamber pressure has 93 windings of a 0.75 $mm^2$ gage copper wire, the operating coil ESSM of the closing magnet SM has 80 windings of a 0.69 $mm^2$ gage copper wire.

If the internal combustion engine is started from cold, a control unit assigned to the actuators initiates measurement of the oil temperature, performed by means of a temperature-measuring sensor on the guide sleeve FHoM on one of the actuators of the internal combustion engine.

If the measured temperature is over 20° Celsius, no preheating of the actuators for electromagnetically controlling valves takes place through the supply of heating current to the operating coils ESÖM,ESSM and therefore the internal combustion engine starts immediately through the initial transient build-up of the actuators. After the initial transient build-up phase of the actuators, the internal combustion engine is in the ignition phase.

If the temperature is below 20° Celsius, for instance 0° Celsius, the actuators are preheated before the initial build-up phase. For this purpose, the operating coils ESÖM,ESSM are supplied with a heating current until the temperature sensor senses an oil temperature of 20° Celsius at the guide sleeve.

FIG. 2 shows the curve against time of the current of the operating coils ESÖM,ESSM for preheating the oil of the guide sleeve FHÖM and for the initial transient of the oscillating mass, as required for an oil temperature of 0° Celsius.

For preheating, both operating coils ESÖM,ESSM are supplied simultaneously with a direct current of 20 ampere as heating current which drops down to 15 ampere after 12 milliseconds because the operating coils ESÖM,ESSM must not exceed a critical temperature of 135° Celsius. Furthermore, a certain small amount of time is required each time before the heat output from the operating coils ESÖM, ESSM has been transferred to the oil through the yoke and the guide sleeve. After a total of 30 milliseconds, the temperature sensor senses an oil temperature of 20° Celsius at the guide sleeve FHÖM, after which the initial transient phase of the actuators commences immediately. The operating coils ESÖM,ESSM are then supplied alternately for a period of 2.5 milliseconds with an initial transient current of only 20 ampere. Until the closing magnet has drawn the gas change valve into the valve seat of the cylinder head, only two excitations of the operating coils ESÖM,ESSM are needed and therefore some of the time span used for preheating has again been saved. From this point of time, the transition from the initial transient of the actuators to the ignition operation of the internal combustion engine takes place automatically and each actuator for electromagnetically controlling a valve is provided with the current curve needed for the working cycle of the gas change valves of the internal combustion engine.

The protection of the operating coils ESÖM,ESSM against exceeding the critical temperature could be effected by a protective circuit which monitors the temperature of the operating coils ESÖM,ESSM and regulates the level of the heating current or the duration of the heating current.

Due to the method for operating actuators for electromagnetically controlling a valve in internal combustion engines, high currents are avoided in the current curve of the operating coils ESÖM,ESSM and thus the power supply unit for the actuators can be dimensioned smaller, control circuits function with fewer error deviations on starting ignition operation, and starting of the internal combustion engine from cold is considerably smoother.

What is claimed is:

1. A method of operating an actuator for electromagnetically controlling a valve in an internal combustion engine, using an actuator having two electromagnets including an opening magnet and a closing magnet between which a retaining plate with at least one plunger oscillates, wherein each one of said electromagnets comprises a respective yoke and a respective operating coil, and wherein said respective yoke of at least one of said electromagnets has a guide sleeve supplied with lubricant for guiding said at least one plunger, said method comprising operating said actuator through an initial transient state by energizing said electromagnets before said internal combustion engine is started, and said method further comprising, before said initial transient state of said actuator commences, supplying a heating current to said respective operating coil of said at least one of said electromagnets of which said respective yoke has said guide sleeve, wherein said heating current causes said respective operating coil and said lubricant of said at least one of said electromagnets to be heated.

2. The method in accordance with claim 1, further comprising controlling said heating current, in at least one of an open loop and a closed loop, wherein at least one of a temperature, an energization time, a current level, and a position of an oscillating part of said actuator is used as a controlled variable.

3. The method in accordance with claim 2, comprising using an oil as said lubricant, and further comprising measuring a temperature of said oil present on said guide sleeve by means of a sensor in order to carry out said controlling of said heating current.

4. The method in accordance with claim 1, comprising using a direct current as said heating current.

5. The method in accordance with claim 1, comprising using an alternating current as said heating current.

6. The method in accordance with claim 1, further comprising controlling a power of said heating current in at least one of an open loop and a closed loop by carrying out at least one of amplitude modulation and pulse width modulation of said heating current.

* * * * *